US005528969A

United States Patent [19]

Kihara et al.

[11] Patent Number: 5,528,969

[45] Date of Patent: Jun. 25, 1996

[54] DAMPER UNIT FOR A PIANO

[75] Inventors: Tsutomu Kihara, Hamamatsu; Kiyoshi Abe, Fukuroi, both of Japan

[73] Assignee: Kabushiki Kaisha Kawai Gakki Seisakusho, Hamamatsu, Japan

[21] Appl. No.: 406,204

[22] Filed: Mar. 17, 1995

[30] Foreign Application Priority Data

Mar. 22, 1994 [JP] Japan ..... 6-050507

[51] Int. Cl.[6] ..... G10C 3/00; G10D 15/00

[52] U.S. Cl. ..... 84/216; 84/220; 84/171

[58] Field of Search ..... 84/216, 217, 218, 84/219, 220, 221, 222, 223, 170, 171, 172, 33, 34, 35, 36, 21, 23

[56] References Cited

U.S. PATENT DOCUMENTS

| | | | |
|---|---|---|---|
| 511,747 | 1/1894 | Bettendorf | 84/220 |
| 686,251 | 12/1901 | Bosenbury | 84/220 |
| 5,374,775 | 12/1994 | Kawamura et al. | 84/171 |

*Primary Examiner*—Cassandra C. Spyrou

*Attorney, Agent, or Firm*—Davis, Bujold & Streck

[57] ABSTRACT

A damper unit for a piano is provided in which the position of a hammer stop rail for contacting the hammer shanks before the hammers strike the strings can be changed from an inoperative retracted position to a stop position with a relatively small drive force and the hammer stop rail is firmly and reliably positioned at the stop position. Stop rail support arms for supporting the hammer stop rail are connected, via linkage mechanisms composed of links and lever arms, to a rotary shaft. By pulling a wire that is connected to the rotary shaft, the rotary shaft is rotated, such that the hammer stop rail can be positioned, via the linkages, at the stop position and the retracted position, in which the hammer stop rail does not contact the hammer shanks. As compared with the conventional damper unit, the position of the hammer stop rail can be changed with a relatively small drive force. Moreover, the hammer stop rail is thus fixedly positioned at the stop position, thereby reliably dampening the hammer striking sound. The linkage mechanisms may be replaced with a cam mechanism that contacts the stop rail support arms for changing the position of the hammer stop rail.

11 Claims, 5 Drawing Sheets

DAMPER UNIT FOR A PIANO

FIELD OF THE INVENTION

The invention relates to a damper unit provided in a piano for halting the motion of the piano's hammer shanks, in response to depression of the piano's keys, before the hammers strike the strings, thereby preventing generation of hammer striking sounds.

BACKGROUND OF THE INVENTION

Composite pianos are known in which an electronic sound source is combined with an acoustic piano. The composite piano can be played both in a normal piano performance mode in which the hammers strike the strings to produce sound, and in an electronic performance mode in which sound is produced by operating the electronic sound source. When such a composite piano is played in the electronic performance mode, the hammer striking sound is prevented by a stop rail that acts as a damper. When the hammer attached to the tip of a hammer shank is about to strike a string, the movement of the hammer shank is checked by the stop rail.

In the normal piano performance mode, the hammer stop rail of the damper unit needs to be positioned in a retracted position where the hammer stop rail does not contact the hammer shanks, thereby allowing the hammers to strike the strings. For this purpose, as shown in FIG. 6, a conventional prior art stop rail support arm 91 is extended from the lower edge of a hammer stop rail 90. The lower end of stop rail support arm 91 is secured to a support shaft 94 extending parallel with a rotary shaft 93 on which a hammer shank 92 pivots. By operating a lever 95 for rotating the support shaft 94, the hammer stop rail 90 is positioned at a stop position, shown by solid lines, where the motion of the hammer shanks 92 is halted by the rail 90 or at a retracted position, shown by dotted lines, where the hammer stop rail 90 does not contact the hammer shanks 92.

In the conventional damper unit, however, when the hammer stop rail 90 is positioned at the stop position or at the retracted position, the shaft 94 supporting the stop rail arm 91 is rotated by directly operating the lever 95 in the directions shown by an arrow. As a result, a relatively large drive force is required for changing the position of the hammer stop rail 90.

Moreover, when the hammer stop rail contacts the hammer shanks at the stop position, the resulting impact causes the support shaft to rotate toward the retracted position and the stop position of the hammer stop rail deviates. The deviation of the stop position of the stop rail 90 toward the retracted position results in unintentional hammer strikes on the strings. Therefore, the string striking sound cannot be effectively and reliably dampened.

SUMMARY OF THE INVENTION

Wherefore, an object of this invention is to provide a damper unit for a piano in which the position of a hammer stop rail can be changed with a relatively small drive force and the hammer stop rail can be firmly and reliably positioned at a specific stop position.

To attain this and other objects, the present invention provides a damper unit for a piano composed of a longitudinal hammer stop rail, a support mechanism and a positioning mechanism. The hammer stop rail halts the motion of the hammer shanks before the hammers strike the strings, by contacting the hammer shanks at a stop position located between a position where the hammer shanks begin to move toward strings of the piano in response to depression of the keys and a position where the hammers strike the strings. The hammer stop rail is selectively displaceably supported by the support mechanism at the stop position and at a retracted position, remote from the stop position, for permitting the hammers to strike the strings. The hammer stop rail is selectively positioned at the stop position and at the retracted position by the positioning mechanism.

In the damper unit according to the invention, the support mechanism is composed of a plurality of stop rail support arms that project substantially radially and perpendicularly from the hammer stop rail at a plurality of positions along the length of the hammer stop rail and the ends of the stop rail support arms, remote from the ends connected to the hammer stop rail, are secured to a support shaft extending parallel with the hammer stop rail.

The positioning mechanism is composed of a linkage mechanism provided with a longitudinal rotary shaft rotatably arranged substantially parallel with the hammer stop rail, a plurality of linkage mechanisms for connecting the rotary shaft and the stop rail support arms, and an externally operated rotating mechanism for rotating the rotary shaft over a specified angle.

The linkage mechanisms comprising the positioning mechanism can be replaced with a cam mechanism. The cam mechanism is composed of a longitudinal cam shaft, a plurality of cams, a biasing member and a rotating mechanism. The cam shaft is provided substantially parallel with the hammer stop rail within the range of pivotal motion of the stop rail support arms. The cams are secured to the cam shaft in the range of pivotal motion of the stop rail support arms for displacing the stop rail support arms between the retracted position and the stop position of the hammer stop rail upon rotation of the cam shaft. The biasing member biases the stop rail support arms toward the cam shaft, thereby placing the stop rail support arms abutting contact with the cams. The cam shaft is rotated over a specified angle by the externally operated rotating mechanism.

The support mechanism for supporting the hammer stop rail of the damper unit is composed of a plurality of stop rail support arms projecting substantially perpendicular from the hammer stop rail at a plurality of positions along the length of the hammer stop rail and a plurality of support members for pivotally supporting the ends of the stop rail support arms along a support shaft that extends parallel with the hammer stop rail. Therefore, when the stop rail support arms pivot on the support members, in the same way as the conventional damper unit shown in FIG. 6, the hammer stop rail is displaced between the stop position where the hammer stop rail contacts the hammer shanks before the hammers strike the strings and the retracted position where the hammer stop rail does not contact the hammer shanks.

The positioning mechanism of the damper unit is a linkage mechanism composed of a longitudinal rotary shaft rotatably provided substantially parallel with the hammer stop rail, a plurality of links for connecting the rotary shaft and the stop rail support arms and an externally operated rotating mechanism for rotating the rotary shaft over a specified angle. When the rotary shaft is rotated by the rotating mechanism, the stop rail support arms are displaced. Therefore, the stop and retracted positions of the hammer stop rail are determined by the number and configuration of the links interconnecting the rotary shaft and the stop rail support arms, the degree of rotation of the rotary shaft when rotated by the rotating mechanism, and by other conditions.

The positioning mechanism can alternatively be a cam mechanism composed of a longitudinal cam shaft provided substantially parallel with the hammer stop rail within the pivot range of the stop rail support arms and a plurality of cams are secured to the cam shaft within the pivot range of the stop rail support arms. The stop rail support arms for supporting the hammer stop rail are biased into engagement with the cams by the biasing member. The cam shaft is rotated by externally operating the rotating mechanism. The rotation of the cam shaft is transmitted to the cams, thereby rotating the cams, which in turn displace the stop rail support arms. The stop and retracted positions of the hammer stop rail are determined by the configuration of cams, the degree of rotation of the cam shaft as rotated by the rotating mechanism, and by other conditions.

BRIEF DESCRIPTION OF THE DRAWINGS

The invention will now be described, by way of example, with reference to the drawings, in which.

DETAILED DESCRIPTION OF THE PREFERRED EMBODIMENTS

In a first embodiment of the invention, an upright piano is a composite piano provided with an electronic sound source, not shown, which produces electronic sounds in response to operation of the keyboard. A player can listen to the electronic sound through headphones during operation of the keyboard, so that no sound is heard by others.

Figure 2:
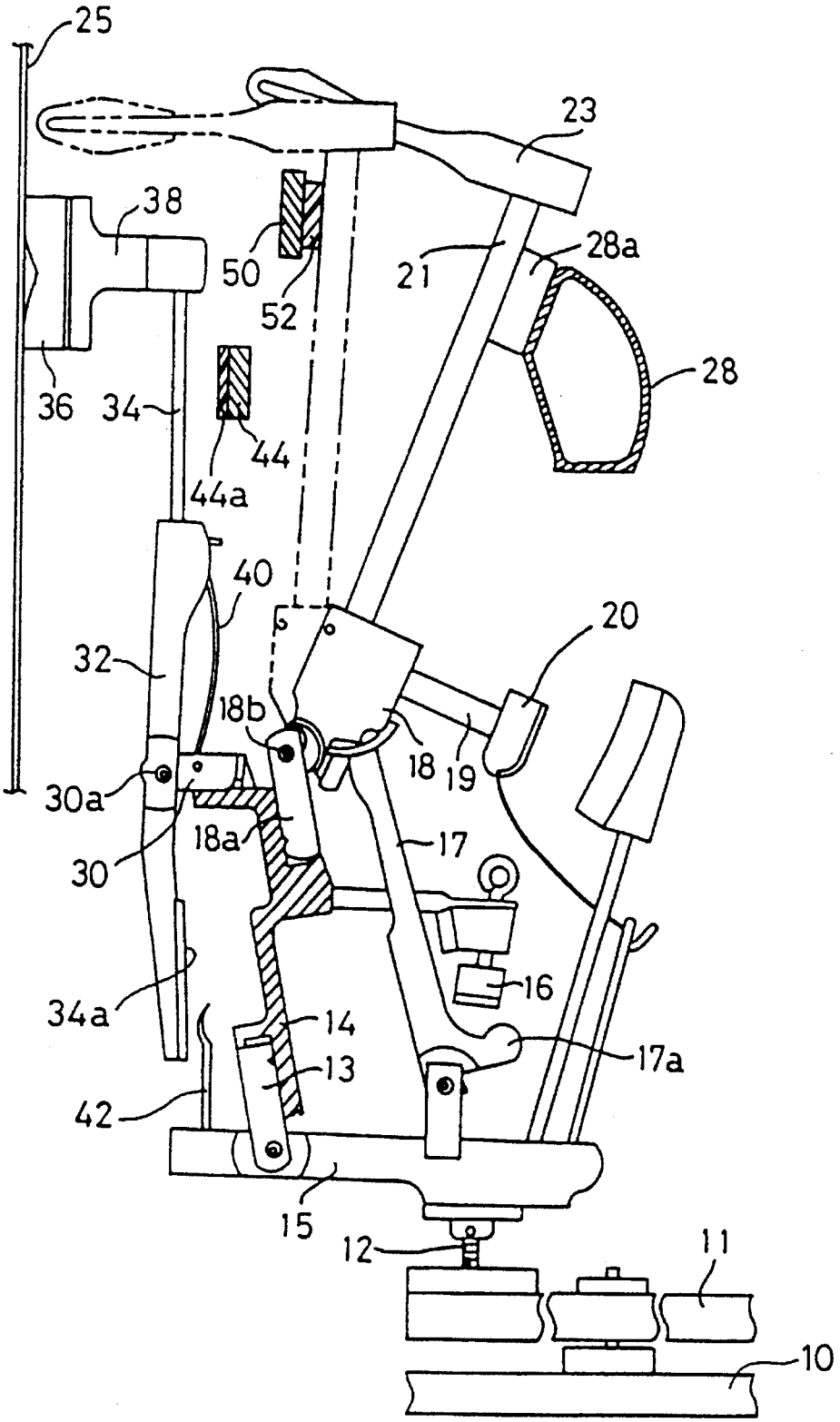
FIG. 2 is a diagrammatic representation showing the mechanical unit for one key of an upright piano provided with the damper unit shown in FIG. 1.

As shown in FIG. 2, the mechanical units, only one of which is shown, of an upright piano are provided with a key bed 10, a key 11, a capstan button 12, an action lever 15 pivotally supported via a wippen flange 13, which in turn is supported by a center rail 14, a jack 17 pivotally connected to the action lever 15 and having a jack tail 17*a*, a hammer butt 18 pivotally supported on a center pin 18*b* of the butt flange 18*a* secured to the center rail 14, a hammer shank 21 detachably connected to the hammer butt 18, a catcher shank 19 extending from the hammer butt 18 substantially perpendicularly to the hammer shank 21, a catcher 20 attached to the tip of the catcher shank 19, a hammer 23 attached to the tip of hammer shank 21 for striking a string 25 and a hammer rail 28 having a cushioning part 28*a*.

When a player depresses the key 11, the capstan button 12 is raised, thereby pivoting the action lever 15 upwards. At the same time, the jack 17 is pivoted upwards until the jack tail 17*a* contacts the bottom face of a regulating button 16. Subsequently, the hammer butt 18 is pushed upwards by the jack 17, thereby pivoting the hammer shank 21 counterclockwise. Upon striking the string 25, the tip of the hammer shank 21 or the hammer 23 bounces off the string 25, and the rear side of the hammer shank 21 contacts the hammer rail 28. The shock arising from the contact between the hammer shank 21 and rail 28 is absorbed by the cushioning part 28*a*.

The damper for suppressing the vibration of the struck string 25 is supported by a support 30 attached to the center rail 14. A damper lever 32 is pivotally supported on a fixed shaft 30*a* of the support 30, and a damper lever wire 34 extends upwardly from the upper tip of the damper lever 32. A damper head 38 having a felt 36 for contacting the string 25 is attached to the tip of the damper lever wire 34. A damper lever spring 40 is spanned between the support 30 and the upper tip of the damper lever 32, for biasing the damper lever 32 toward the string 25 such that the felt 36 of damper head 38 contacts the string 25. At the end of the action lever 15 opposite to the capstan button 12, a damper spoon 42 is attached in an upright position. When the key 11 is depressed, the rotation of the action lever 15 places the damper spoon 42 in contact with the lower part of damper lever 32, thereby pivoting the damper lever 32 clockwise. Subsequently, the damper lever wire 34 contacts a damper stop rail 44, thereby stopping further clockwise rotation of the damper lever wire 34. The lower part of the damper lever 32 and the surface of the damper stop rail 44 are provided with cushioning felts 34*a* and 44*a*, respectively.

The center rail 14, the hammer rail 28 and the damper stop rail 44 are secured to a action bracket 54, as described later. A plurality of action brackets 54 are provided at a plurality of places along the keys of the upright piano, for example, provided at both ends and in the middle between these ends.

A hammer stop rail 50 is provided within the range of motion of hammer shank 21, when striking the string 25, for contacting and halting the hammer shank 21 before the hammer 23 strikes the string 25. The hammer stop rail 50 extends along the keys in each tone range, for halting the motion of the hammer shanks 21 in each tone range and thereby dampening the string striking sound. The contact face of the hammer stop rail 50, for contacting the hammer shank 21, is provided with a cushioning felt 52 for absorbing the contact shock when the hammer shanks 21 impact upon the stop rail 50.

Figure 1:
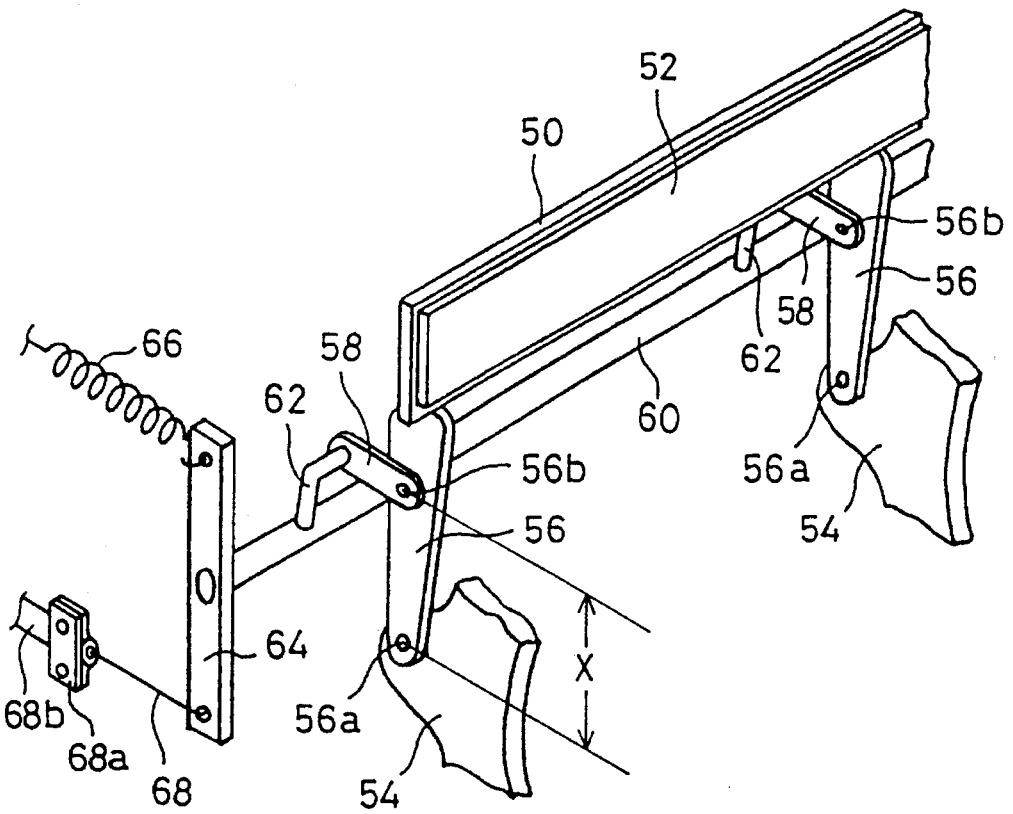
FIG. 1 is a perspective view showing the structure of a damper unit according to a first embodiment of the invention.

The damper unit of the first embodiment, including the aforementioned hammer stop rail 50, is now explained referring to FIG. 1.

Figure 3:
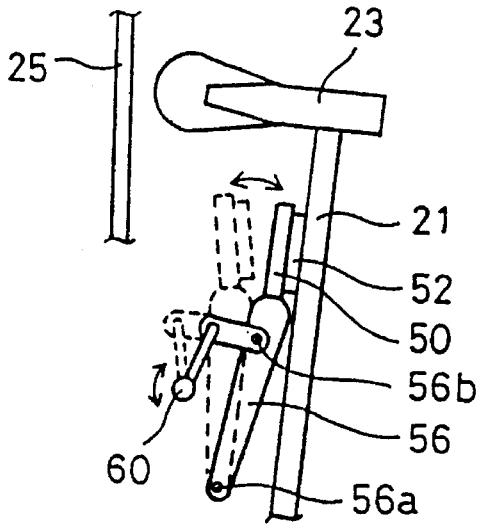
FIG. 3 is an explanatory view showing the displacement of the damper unit shown in FIG. 1 between the stop position and the retracted position.
Figure 7:
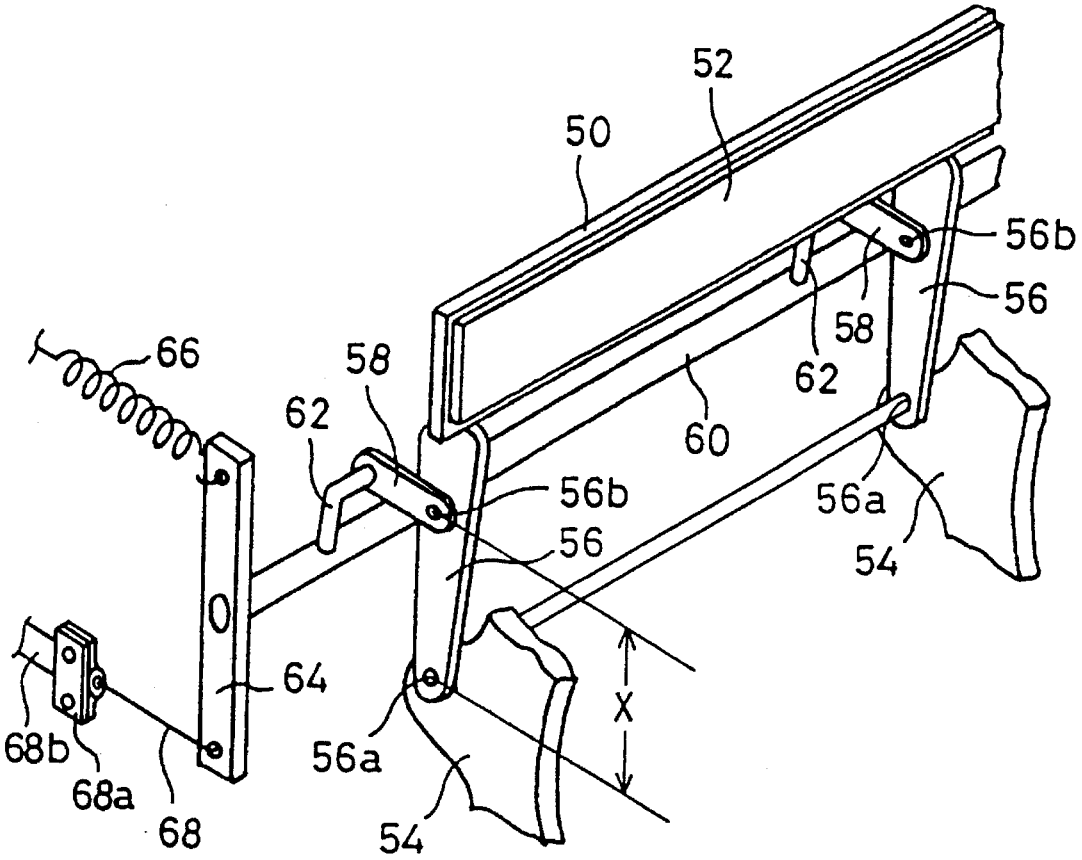
FIG. 7 is a third embodiment of the damper unit of FIG. 1.

As shown in FIG. 1, stop rail support arms 56 extend radially and perpendicularly from the lower edge of the hammer stop rail 50 toward the corresponding action brackets 54. The lower ends of the stop rail support arms 56 are pivotally secured to the action brackets 54, via support pins 56*a* or by a support shaft (illustrated in FIG. 7). As shown in FIG. 3, the hammer stop rail 50 pivots about the support pins 56*a*, such that the rail 50 is moved from a stop position, shown by solid lines, where the rail 50 contacts the hammer shanks 21 before the shank 21 strikes the string, to a retracted position, shown by dotted lines, where the hammer stop rail 50 does not contact the hammer shanks 21.

A longitudinal rotary shaft 60 is provided parallel with the hammer stop rail 50 for pivoting the stop rail support arm 56. As shown in FIG. 1, the rotary shaft 60 is connected to the stop rail support arms 56 via linkage mechanisms composed by of links 58 and lever arms 62. One end of each link 58 is pivotally secured with a fixing screw 56*b* to the stop rail support arm 56 and the other end of each link 58 is pivotally connected to one end of a corresponding lever arm 62. The other end of the lever arm 62 is secured to the rotary shaft 60.

An operating bar 64 extends radially and perpendicularly from one or both ends of the rotary shaft 60 for rotating the rotary shaft 60 over a specified angle. One end of the operating bar 64 is connected to a coil spring 66 for biasing the hammer stop rail 50 toward the retracted position. The other end of the operating bar 64 is connected to a wire 68 for rotating the rotary shaft 60 against the force of the coil spring 66 by pulling on the wire 68.

The rotary shaft 60 is rotatably secured by a support mechanism, not shown, provided adjacent to each side board of the upright piano. The end of the coil spring 66, that is remote from the end connected to the operating bar 64, is secured to the body of the upright piano, not shown.

The wire 68 extends from the operating bar 64 and passes through tubing **68*b* secured to the body of the upright piano with a fastener. The remote end of the wire 68, not shown, is connected to an operating lever, not shown, provided on the lower surface of the key bed 10 of the upright piano. By operating the operating lever, the wire 68 is drawn through the tubing 68*b*, thereby pivoting the operating bar 64 and rotating the rotary shaft 60 against the bias of the coil spring 66**.

Figure 6:
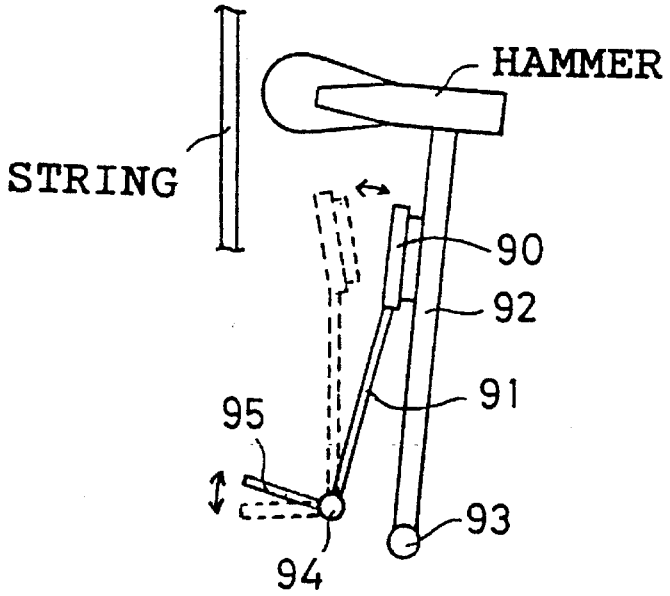
FIG. 6 PRIOR ART
FIG. 6 is an explanatory view showing the structure and operation of the conventional damper unit.

The damper unit of the first embodiment is different from the conventional damper unit shown in FIG. 6. In a conventional damper unit the support shaft 94 of the stop rail support arm 91 is rotated by directly operating the lever 95 which extends directly from the support shaft 94. Whereas in the damper unit according to the present invention the rotary shaft 60 is connected to the stop rail support arms 56 via the linkages composed of the links 58 and the lever arms 62 and is pivoted by the external operation of the operating lever, which rotates the rotary shaft, not the support shaft. By rotating the rotary shaft 60, as shown in FIG. 3, the hammer stop rail 50 is positioned via the linkage at the stop position, shown by solid lines, where the rail 50 contacts and stops the hammer shanks 21, thereby preventing the string striking sound or at the retracted position, shown by dotted lines, where the rail 50 does not contact the hammer shanks 21. The linkages are connected to the stop rail support arms 56 at a location spaced from the support pins **56*a***, the pivot axis of the support, by a distance X. Consequently, the damper unit of the first embodiment requires less drive force for changing the position of the hammer stop rail as compared with the conventional damper unit.

As described above, the hammer stop rail 50 is positioned at the stop position or at the retracted position by the linkages composed of the links 58 and the lever arms 62. When the hammer stop rail 50 contacts the hammer shanks 21 at the stop position, the resulting impact force is absorbed by the linkages. Therefore, the stop position of the hammer shank 21 is prevented from deviating from the specific stop position toward the retracted position. In this case, the hammer stop rail 50 is positioned at the stop position by the lever arms 62. Consequently, in the first embodiment the hammer 23 can be firmly and reliably stopped at the desired stop position.

The position of the hammer stop rail 50 is determined by the length of wire 68 extending from the fastener **68*a* to the operating bar 64. The stop position or retracted position of the hammer stop rail 50 can be easily adjusted by adjusting the attachment position of the wire 68 relative to the operating lever and thereby adjusting the amount of wire 68 that is drawn through the tubing 68*b*** upon operation of the operating lever.

In the damper unit of the aforementioned first embodiment, the hammer stop rail 50 is positioned by the linkages connecting the stop rail support arm 56 to the rotary shaft 60. In a second embodiment shown in FIG. 4, the hammer stop rail 50 is positioned by a cam mechanism in abutting contact with the stop rail support arms 76. The results achieved by the second embodiment are the same as those achieved by the first embodiment.

Figure 4:
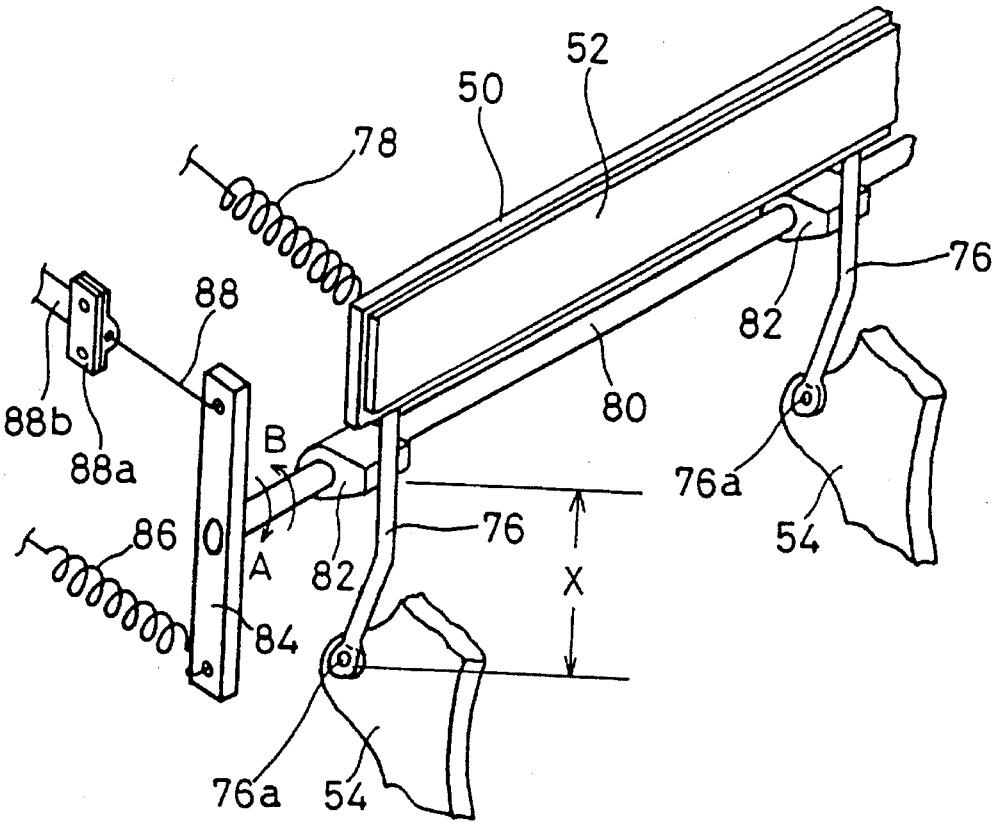
FIG. 4 is a perspective view showing the structure of the damper unit according to a second embodiment of the invention.

In the damper unit of the second embodiment shown in FIG. 4, a plurality of stop rail support arms 76 extend radially and perpendicularly from the lower edge of the hammer stop rail 50. The lower ends of the stop rail support arms 76 are pivotally secured via support pins **76*a* or a support shaft to the action brackets 54. A cam shaft 80, similar to the rotary shaft 60 of the first embodiment, is rotatably supported by support mechanisms, not shown, provided adjacent to the opposite side boards of the upright piano. Cams 82 provided on the cam shaft 80 contact corresponding stop rail support arms 76. One end of a coil spring 78 is secured to the surface of the stop rail 50, opposite to the cushioning felt 52, for biasing the hammer stop rail 50 toward the retracted position and maintaining the stop rail support arms 76 in abutting contact with the cams 82. One end of the cam shaft 80 is provided with an operating bar 84. A coil spring 86 is connected to the lower end of the operating bar 84 for rotating the operating bar 84, and the cam shaft 80, in the direction shown by arrow A in FIG. 4. The upper end of the operating bar 84 is connected to a wire 88. The operating bar 84 and the cam shaft 80 are rotated in the direction shown by arrow B, in opposition to the coil spring 86, by externally operating the wire 88, until the operating bar 84 becomes vertical as shown in FIG. 4. The wire 88 is secured via a fastener 88*a* to the body of the upright piano and the wire 88 passes through tubing 88*b* and the end of the wire 88**, not shown, is attached to an operating lever, not shown, as described in the first embodiment.

Figure 5:
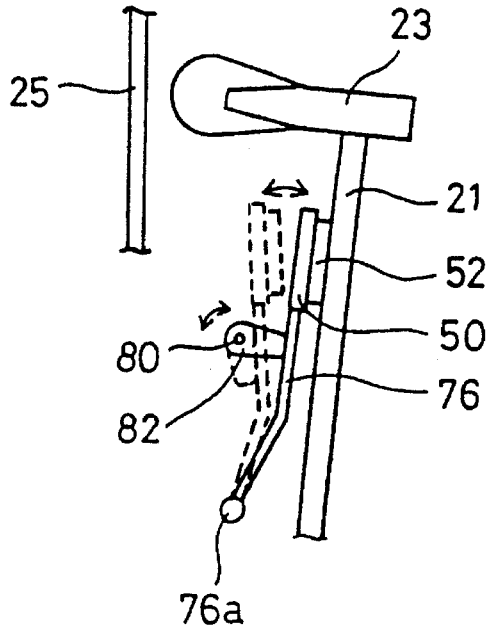
FIG. 5 is an explanatory view showing the displacement of the damper unit shown in FIG. 4 between the stop position and the retracted position.

The damper unit of the second embodiment, as shown in FIG. 4, is operated by drawing the wire 88 through the tubing **88*b* by operating the operating lever, and thereby rotating the cam shaft 80 with the cams 82 thereon. As the cams 82 rotate with the cam shaft 80 they displace the hammer stop rail 50 from the retracted position, shown by dotted lines in FIG. 5, to the stop position, shown by solid lines. In the same way as in the first embodiment, the position of the hammer stop rail can be changed with a relatively small drive force as compared with conventional damper units. At the same time, the hammer 23** can be firmly and reliably stopped at the desired stop position.

In the damper unit of the second embodiment, the position of the hammer stop rail 50 is determined by the length of wire 88 extending between the fastener **88*a* and the operating bar 84. The stop and retracted positions of the hammer stop rail 50 can be easily set by adjusting the attachment position of the operating lever to the wire 88 and thereby adjusting the amount of wire 88 that is drawn through the tubing 88*b*** with the operating lever.

This invention has been described above with reference to the preferred embodiments as shown in the figures. Modifications and alterations may become apparent to one skilled in the art upon reading and understanding the specification. Despite the use of the embodiments for illustration purposes, the invention is intended to include all such modifications and alterations within the spirit and scope of the appended claims.

In the aforementioned embodiments the cushioning felt 52 is attached to the hammer stop rail 50 for absorbing the shock arising when the hammer stop rail 50 contacts the hammer shank 21. Alternatively, a plurality of different pieces of cushioning felt can be provided for respective tone ranges or hammer shanks. By adjusting the thickness of cushioning felt pieces for each tone range or scale, the stop position of each hammer can be determined.

Instead of the cushioning felt 52, rubber or other elastic material can be attached to the hammer stop rail 50 for absorbing the shock arising when the stop rail 50 contacts the hammer shanks 21.

In the aforementioned embodiments, the rotary shaft 60 as well as the cam shaft 80 are rotatably supported by support mechanisms, not shown, provided adjacent to the opposite side boards of the upright piano. Alternatively, by modifying the configuration of the action brackets 54, the rotary shaft 60 or the cam shaft 80 can be rotatably secured to the action brackets 54.

Although the damper unit of the invention is applied to an upright piano in the aforementioned embodiments, it can be applied to a grand piano.

In the conventional damper unit, the support shaft of the stop rail support arms is directly rotated by operating a lever that extends directly from the support shaft. Whereas in the damper unit of the present invention, the stop rail support arms are indirectly pivoted via the support shaft and the linkage mechanisms or the cam mechanism. each of which act upon the stop rail support arms at a location that is spaced from the support shaft or support members by a distance X. Therefore, in the damper unit according to the present invention, the position of the hammer stop rail can be changed with a smaller drive force than in a conventional damper unit. Furthermore, the impact force exerted to the hammer stop rail toward the retracted position when the hammer shanks contact the hammer stop rail at the stop position is absorbed by the linkage mechanism or the cam mechanism. Therefore, when the hammer stop rail contacts the hammer shanks at the stop position, the hammer stop rail is prevented from pivoting toward the retracted position. Thus, the deviation in the stop position of the stop rail is avoided. Consequently, in the invention, the motion of the hammers can be reliably halted at the desired stop position.

What is claimed is:

1. A damper unit for mounting in a piano having a plurality of strings and a plurality of hammers on a plurality of hammer shanks for striking the strings and creating string sound, said damper unit comprising:

a support shaft mounted in the piano, said support shaft having a plurality of support arms pivotally projecting from a plurality of places along a length of said support shaft;

a hammer shank stop rail secured to ends of said support arms remote from said support shaft, whereby the said stop rail is supported within said piano, between the strings of the piano and the hammer shanks of the piano, for pivotal motion about a pivoting axis extending along a longitudinal axis of said support shaft; and a longitudinal rotary shaft rotatably mounted in said piano substantially parallel with said stop rail;

wherein at least one moving device is mounted to said rotary shaft, such that said at least one moving device contacts and is coupled with at least one of said support arms at a location along a length of said at least one support arm spaced from said pivoting axis, whereby, upon rotation of said rotary shaft, said at least one moving device applies a motive force to said at least one of said support arms at said location, thereby pivoting said support arms about said pivoting axis, for selectively moving said stop rail in a first direction, from a) a retracted position outside a range of motion of said hammer shanks, for allowing hammers on the hammer shanks to strike the strings, into b) a stop position within the range of motion of the hammer shanks, in which, upon motion of the hammer shanks toward the strings, said stop rail contacts the hammer shanks, for halting the motion of the hammer shanks before the hammers strike the strings.

2. A damper unit according to claim 1, wherein said at least one moving device comprises a linkage mechanism comprising:

a lever arm that is secured to and extends radially from said rotary shaft; and a link, a first end of said link is pivotally connected to an end of said lever arm remote from said rotary shaft and a second end of said link is pivotally connected to said at least one support arm at said location.

3. A damper unit according to claim 2, further comprising an operating mechanism mounted on an outer surface of the piano and operatively connected to said rotary shaft, whereby said operating mechanism is actuatable for rotating said rotary shaft over an angle that is sufficiently large to move said stop rail from said retracted position to said stop position.

4. A damper unit according to claim 3, further comprising:

an operating bar that is secured to and extends radially from said rotary shaft;

a first biasing member, mounted between a frame of the piano and a first end of the operating bar remote from said rotary shaft, for applying a biasing force to said first end of said operating bar, and thereby rotationally biasing said rotary shaft in a first direction and biasing said stop rail into said retracted position; and an operating wire, a first end of said wire is connected to a second end of said operating bar, remote from said first end and said rotary shaft, and a second end of said wire is connected to said operating mechanism, whereby, upon actuation of said operating mechanism, said operating mechanism pulls on said wire and thereby applies an actuating force upon the second end of said operating bar, thereby rotating said rotary shaft in a second direction, opposite said first direction, and thereby moving said stop rail, via said linkage, from said retracted position into said stop position.

5. A damper unit according to claim 4, further comprising a plurality of said linkage mechanisms spaced along a length of said rotary shaft, such that each of said linkage mechanisms are connected to a corresponding one of said support arms, at said location, for applying said motive force to each of said support arms.

6. A damper unit according to claim 2, comprising a plurality of said linkage mechanisms that are spaced along a length of said rotary shaft, such that each of said linkage mechanisms are connected to a corresponding one of said support arms, at said location and applying said motive force to each of said support arms.

7. A damper unit according to claim 1 wherein said at least one moving member comprises a cam member that is non-rotatably secured to said rotary shaft, and said rotary shaft is located within a pivot range of said support arms when moving said stop rail from said retracted position to said stop position;

a stop rail biasing member, mounted between a frame of the piano and said stop rail, that biases said stop rail in a first direction, into said retraced position and toward said rotary shaft and, thereby biasing said at least one support arm into abutting contact with said cam member, such that said cam member contacts said support arm at said location and, upon rotation of said rotary shaft, applies said motive force to said support arm and moves said stop rail from said retracted position to said stop position.

8. A damper unit according to claim 7, further comprising an operating mechanism mounted on an outer surface of the piano and operatively connected to said rotary shaft, whereby said operating mechanism is actuatable for rotating said rotary shaft over an angle that is sufficiently large to move said stop rail from said retracted position to said stop position.

9. A damper unit according to claim 8, wherein said operating mechanism comprises:

an operating bar that is secured to and extends radially from said rotary shaft;

an operating bar biasing member, mounted between a frame of the piano and a first end of the operating bar remote from said rotary shaft, for applying a biasing force to said first end of said operating bar, and thereby rotationally biasing said rotary shaft in a first direction in which said cam locates said stop rail in said retracted position; and an operating wire, a first end of said wire is connected to a second end of said operating bar, remote from said first end and said rotary shaft, and a second end of said wire is connected to said operating mechanism, whereby, upon actuation of said operating mechanism, said operating mechanism pulls on said wire and thereby applies an actuating force upon the second end of said operating bar, thereby rotating said rotary shaft in a second direction, opposite said first direction, and thereby moving said stop rail, via said cam, from said retracted position into said stop position.

10. A damper unit according to claim 7, comprising a plurality of said cam members spaced along a length of said rotary shaft, for abutting corresponding said support arms at said location and applying said motive force to each of said support arm.

11. A method for selectively preventing string striking sounds in a piano comprising the steps of:

providing a stop rail having a contact surface for contacting hammer shanks of said piano at a stop position, located between a position where said hammer shanks start moving toward strings of said piano, in response to depression of corresponding keys of said piano, and a position where hammers on said hammer shanks strike said strings, for halting the motion of said shanks before said hammers strike said strings;

providing a support mechanism selectively displaceably supporting said stop rail at said stop position and at a retracted position, remote from said stop position, for permitting said hammers to strike said strings, said support mechanism comprises a plurality of support arms that project substantially perpendicularly from said stop rail, at a plurality of places along a length of said stop rail, and a support shaft that is rotatably mounted in said piano and that extends parallel to said stop rail, ends of said support arms, remote from said stop rail, are secured to said support shaft, such that said support arms and said stop rail are supported by said support shaft and pivot about a rotational axis of said support shaft;

providing a positioning mechanism for selectively positioning said stop rail at said stop position and at said retracted position, said positioning mechanism comprises a longitudinal rotary shaft that is rotatably mounted in said piano and extends substantially parallel with said stop rail and at least one moving device that is connected to said rotary shaft for, upon rotation of said rotary shaft, applying a motive force to at least one of said support arms, at a location, along a length of said at least one support arm, that is spaced from said rotational axis of said support shaft, and thereby pivoting said support arm and said stop rail about said rotational axis of said support shaft and selectively moving said stop rail into said retracted position and into said stop position; and selectively rotating said rotary shaft and thereby applying said motive force to said support arm.

* * * * *